US005703998A

United States Patent [19]

Eckman

[11] Patent Number: 5,703,998

[45] Date of Patent: Dec. 30, 1997

[54] HOT WATER TANK ASSEMBLY

[75] Inventor: Charles M. Eckman, Dallas, Pa.

[73] Assignee: Energy Convertors, Inc., Dallas, Pa.

[21] Appl. No.: 326,512

[22] Filed: Oct. 20, 1994

[51] Int. Cl.[6] ..... F24H 7/00; F24H 1/20

[52] U.S. Cl. ..... 392/340; 392/341; 392/441; 392/451; 392/497; 126/361

[58] Field of Search ..... 392/451, 500, 392/501, 480, 489, 443, 444, 470, 341, 346, 497, 445, 449; 219/477, 480, 523, 525, 484, 486; 338/239; 126/361; 122/13.1, 494; 220/410, 420

[56] References Cited

U.S. PATENT DOCUMENTS

| | | | |
|---|---|---|---|
| D. 224,406 | 7/1972 | Heck | D26/1 |
| 1,046,465 | 12/1912 | Hoyt . | |
| 1,281,157 | 10/1918 | Hadaway, Jr. . | |
| 1,987,119 | 1/1935 | Long | 219/39 |
| 2,274,445 | 2/1942 | Greer | 219/38 |
| 2,456,343 | 12/1948 | Tuttle | 338/239 |
| 3,352,999 | 11/1967 | Macoicz et al. | 219/486 |
| 3,496,517 | 9/1967 | Walter | 339/18 |
| 3,564,589 | 2/1971 | Arak | 219/331 |
| 3,707,618 | 12/1972 | Zeitlin et al. | 219/336 |
| 3,831,129 | 8/1974 | Frey | 339/19 |
| 4,046,989 | 9/1977 | Parise et al. | 219/437 |
| 4,058,702 | 11/1977 | Jerles | 219/321 |
| 4,152,578 | 5/1979 | Jacobs | 219/336 |
| 4,217,483 | 8/1980 | Vogel et al. | 219/541 |
| 4,419,567 | 12/1983 | Murphy et al. | 219/336 |
| 4,641,012 | 2/1987 | Roberts | 219/331 |
| 4,687,905 | 8/1987 | Cunningham et al. | 219/336 |
| 4,865,014 | 9/1989 | Nelson | 392/451 |
| 4,913,666 | 4/1990 | Murphy | 439/709 |
| 4,948,948 | 8/1990 | Lesage | 219/329 |
| 5,066,852 | 11/1991 | Willbanks | 219/544 |
| 5,113,480 | 5/1992 | Murphy et al. | 392/501 |
| 5,293,446 | 3/1994 | Owens et al. | 392/449 |

OTHER PUBLICATIONS

Patent Application No. 2,043,052; Canada; Murphy et al. Apr. 27,1992.

Immersion Heaters Oil and Water, p. 11 (19_).

Special Purpose Flange Heaters, p. 58 (19_).

Lakewood Trade Literature entitled "Oil-Filled Radiator Heater" (19_).

Encon Drawing Part Nos. 02-06-480 & 02-06-481 (19_).

Encon Drawing No. 500765 (Jun. 10, 1987).

Vulcan Electric Company Trade Literature entitled "Bushing Immersion Heaters", 1983.

Western Electric Technical Digest No. 60 entitled "Pin Shorting Contact", p. 25, Oct. 1980.

*Primary Examiner*—Tu B. Hoang

*Attorney, Agent, or Firm*—Duane, Morris & Heckscher

[57] ABSTRACT

Hot water heaters are provided which contain improved temperature control devices and multiple resistance wire heating elements. The temperature control devices selectively deactivate at least one of the resistance wires to conserve electricity and preserve a steady-state hot beverage or hot water service temperature.

2 Claims, 5 Drawing Sheets

HOT WATER TANK ASSEMBLY

FIELD OF THE INVENTION

Figure 1:
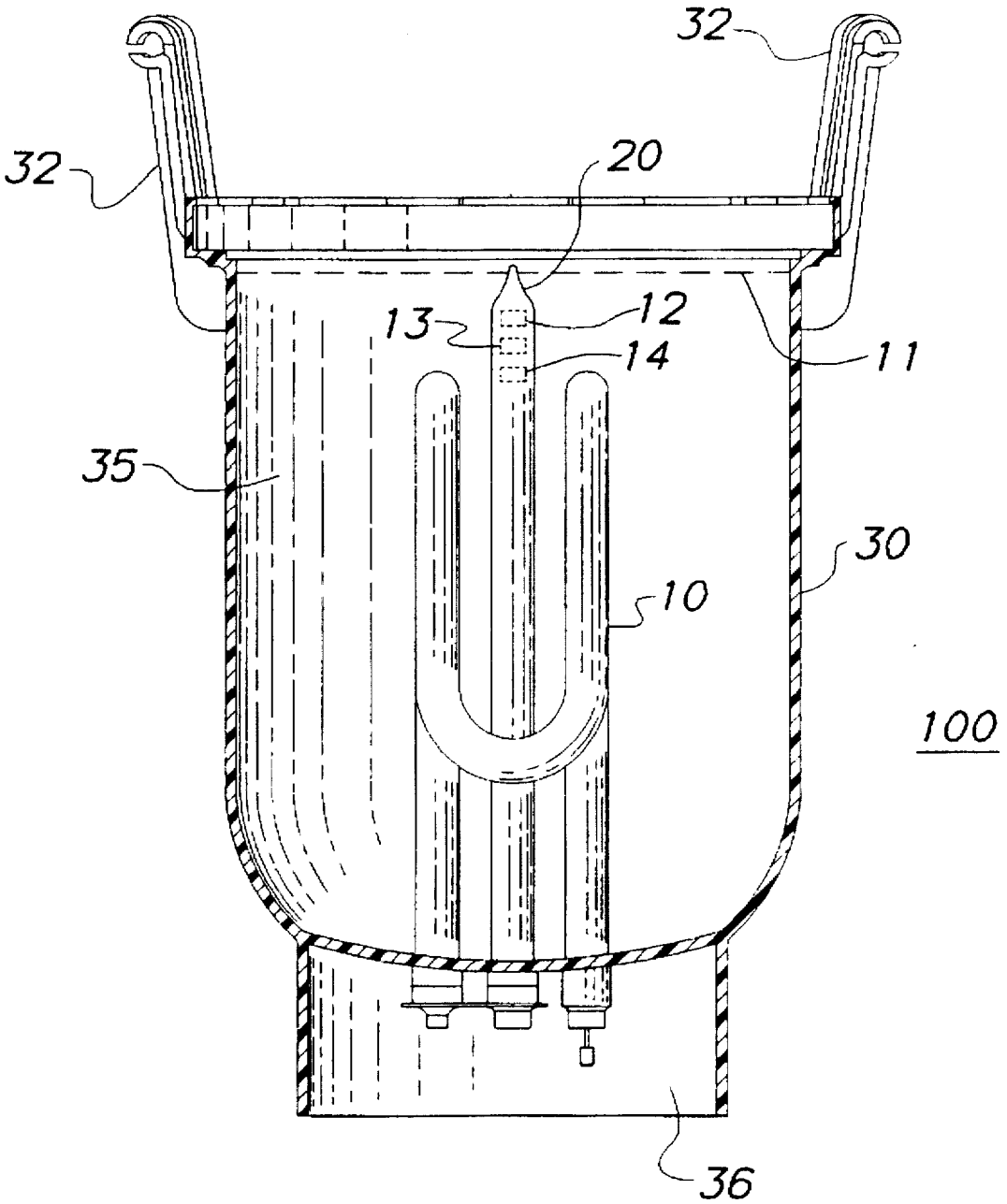

This invention relates to multiple electrical resistance heating elements, and particularly those useful in connection with hot water heaters and portable water dispensers, such as water coolers.

BACKGROUND OF THE INVENTION

It has been suggested that sheathed electrical resistance heating elements could be used in connection with plastic hot water tanks, as disclosed in U.S. Pat. No. 4,687,905, for example. Such elements typically include a single resistance coil affixed at both ends to contact terminals. The coil is encapsulated in a plastic or metal sheath, and is separated from the sheath with a packed granular refractory material that surrounds the coiled wire resistance element.

With the recent popularity of plastic hot water tanks, overheating of the electric resistance heating element is liable to damage the tank significantly if the element were energized in a dry tank. It is rather unimportant whether the sheath is made of plastic or metal, since in either case, the element is likely to fail if no water is present to provide convective cooling.

In order to avoid this problem, the inventor of the element disclosed in U.S. Pat. No. 4,687,905 teaches the use of a thermal cut-off device, which discontinues electric service to the element if the temperature reaches a level at which damage is likely to occur.

In order to afford multiple wattage designs and a back-up system in case of failure of an element, dual elements have also been developed. See U.S. Pat. Nos. 3,707,618 and 5,113,480. The element of the '480 patent employs two U-shaped sheathed resistance wires of different lengths. The element of the '618 patent, typically called a "cartridge heater", contains a ceramic body upon which two or three heating element coils are disposed. The coils are connected to the contact terminals which pass through, or over, the ceramic body.

While such prior art elements have been useful, they are relatively expensive and have not been used in hot water applications in a way that conserves electricity.

SUMMARY OF THE INVENTION

The present invention provides in a first embodiment, a hot water heater for a portable dispenser containing a storage tank for containing water. The heater further includes a heating element for providing electric resistance heating to a portion of the water in the tank. The heating element includes first and second resistance wires which are capable of heating the water to at least that of a hot beverage temperature, at least above 100°. Upon obtaining that temperature, a first resistance wire is selectively discontinued, and the second resistance wire continues to maintain the water at said hot beverage temperature.

Accordingly, the hot water heaters of this invention maintain the water in the tank at a steady-state temperature indefinitely until the unit is turned off. The second resistance wire can be designed to generate only the amount of power needed to account for what the fluid in the container will lose in radiant and convective cooling.

When one compares the principles of this invention to an ordinary single heating element fluid heater, the energy conservation savings will become apparent. Ordinary single element heaters typically develop a temperature cycle from 175° to 195° F. over a 20–60 minute period. Since the heating element is constantly "kicking" on and off, such water heaters are relatively insufficient. The water heaters of this invention, on the other hand, employ a large wattage source, for example, 480 watts, generated by one or both resistance wires, followed by a maintenance wattage of much lower power, for example, 80 watts, generated by a single resistance wire. This temperature control can be easily accommodated, for example, by the use of thermostats strategically located within the storage tank at different levels in the fluid.

In a further embodiment of this invention, a multiple resistance heating element for a water heater is provided. The heating element contains at least first and second resistance wire coils insulated from a corrosion-resistant sheath by an insulating medium packed around the wire coils. The corrosion-resistant sheath contains a pair of free ends which are held by a retention means, for example, a portion of the storage tank or a flange.

In a still further embodiment of this invention, a hot water heater is provided including a polymeric storage tank and an electrical resistance heating element. The heating element includes first and second resistance wire coils. These coils can be incorporated into a single sheath, or located within multiple corrosion-resistant sheaths. In this embodiment, the first resistance wire coil provides electric resistance heating to a portion of the water or other fluid contained in the polymeric storage tank to elevate the temperature of this fluid to a hot beverage temperature between about 150°–200° F., preferably about 175°–190° F. The second resistance wire coil thereafter maintains the fluid at or above the hot beverage temperature in a substantially steady-state condition. This embodiment also includes temperature controls means for selectively providing electric current to at least the first resistance wire coil. The temperature control means is designed for cutting off electric current to the first resistance wire coil when the fluid achieves a preselected temperature between about 150°–200° F., for example.

Since the preferred hot water heaters of this invention, when used for water cooler or portable water dispenser applications, are designed to operate continuously at a low wattage, they can achieve up to about 5–7 years of life without replacing the heating element. Single coil elements, on the other hand, because of their need to cycle every 20–60 minutes or so, generally have a life expectancy of about 2½–3 years. This invention achieves this unexpected extended useful life because it does not require the overheating, and/or underheating of the water during use, and this can be translated into energy savings.

A BRIEF DESCRIPTION OF THE DRAWINGS

Figure 2:
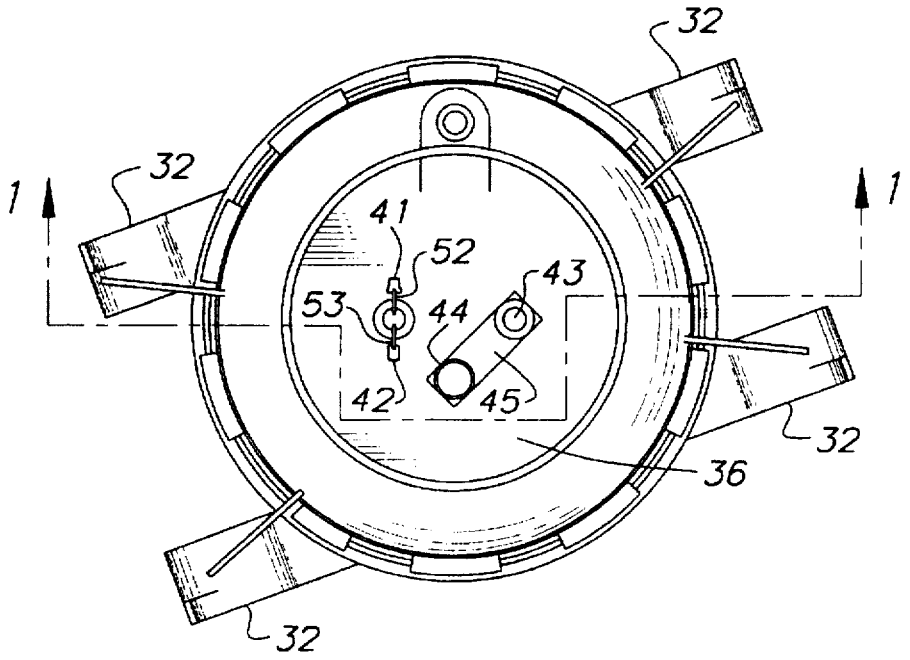
Figure 3:
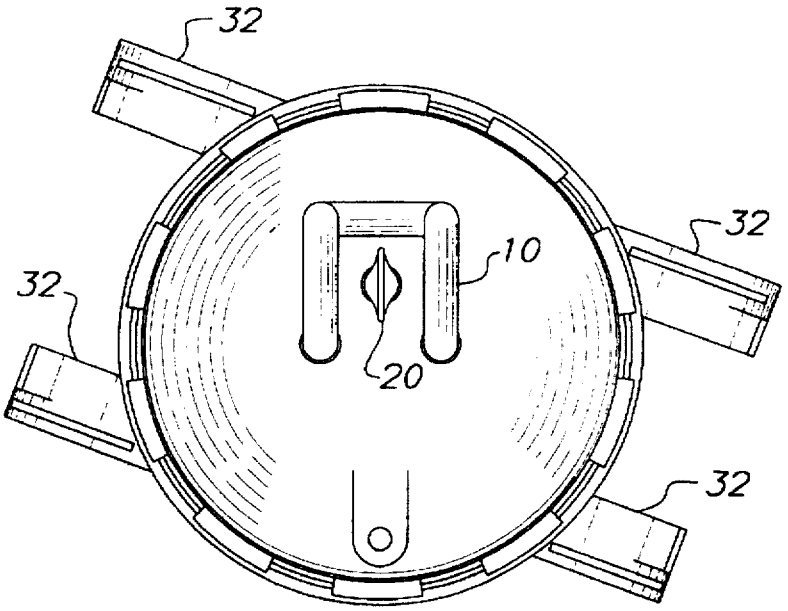
Figure 4:
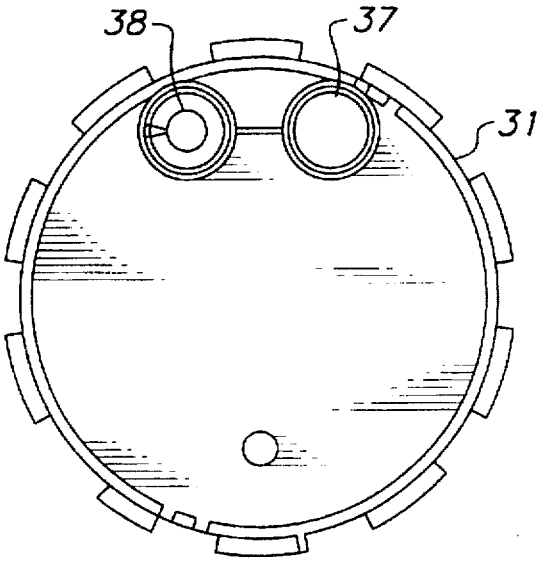
Figure 5:
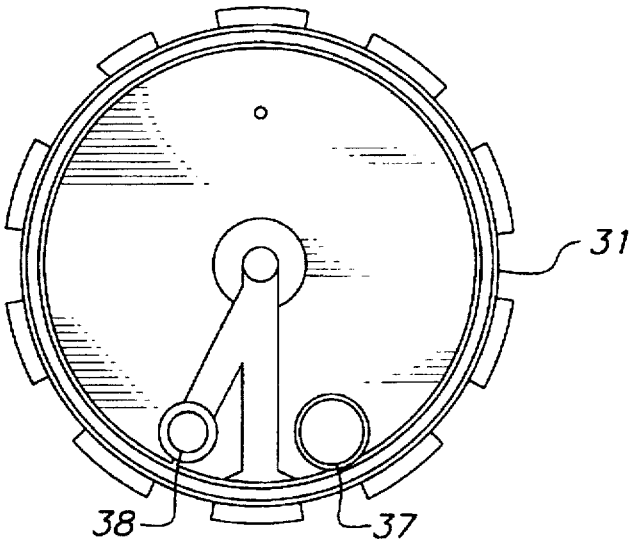
Figure 6:
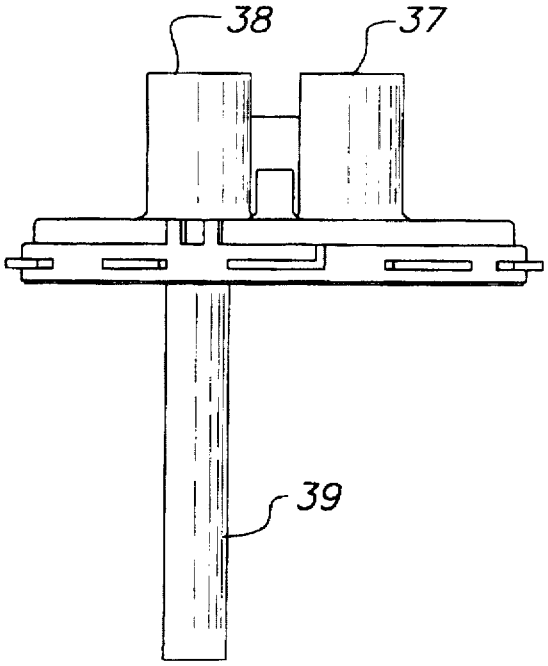
Figure 7:
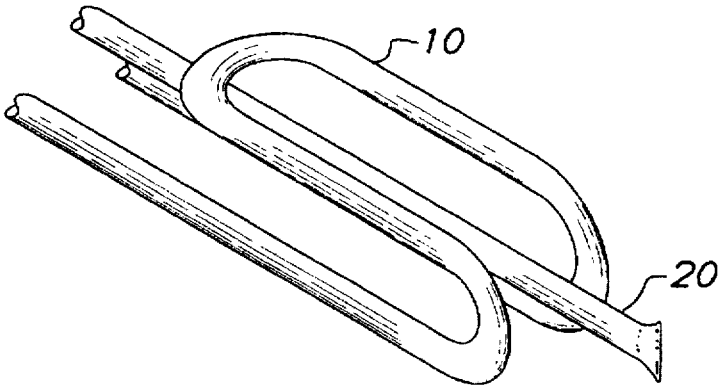
Figure 9:
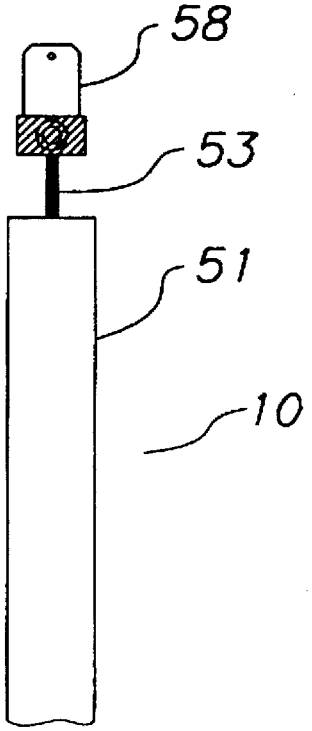
Figure 8:
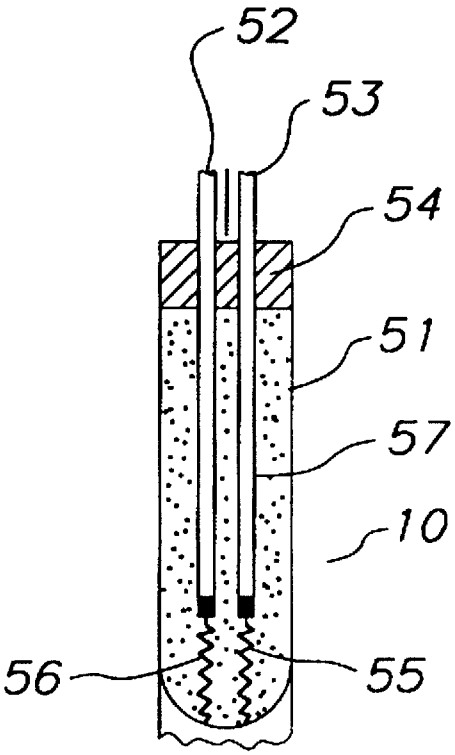

The accompanying drawings illustrate preferred embodiments of the invention, as well as other information pertinent to the disclosure, in which:

FIG. 1: is a side planar, partial cross-sectional view of a hot water heater of this invention;

FIG. 2: is a bottom planar view of the hot water heater of FIG. 1;

FIG. 3: is a top planar view of the hot water heater of FIG. 1;

FIG. 4: is a top planar view of a preferred lid for the hot water heater of FIG. 1;

FIG. 5: is a bottom planar view of the lid of FIG. 4;

FIG. 6: is a side planar view of the lid of FIG. 4;

FIG. 7: is a partial front perspective view of the heating element and temperature control device of the preferred hot water heater of FIG. 1;

FIG. 8: is a side planar, partial cross-sectional view of the heating element of FIG. 7; and FIG. 9: is a side planar, partial view of the heating element of FIG. 7, showing the addition of a clip on one of the power terminal pins.

A DETAILED DESCRIPTION OF THE INVENTION

The present invention involves hot water heaters that use electrical resistance heating elements for heating fluids. The heating elements of this invention are particularly useful in oil heaters, portable water dispensers, such as water coolers, vending machines and commercial and residential hot water heaters. Such water heaters can include both metal and polymer storage tanks.

With respect to the figures and particularly to FIGS. 1–3 thereof, a preferred hot water heater 100 is provided, having a heating element 10 and high temperature control device 20 immersed in a fluid 35, such as water or, in certain applications, oil. The hot water heater 100 preferably includes a storage tank 30, made of a polymer or metal. The storage tank 30 can further contain a wiring compartment 36 insulated from and separated from the fluid 35 contained within the storage tank 30. The storage tank 30 can further include tank supports 32 or legs which can retain the structure a distance away from a supporting surface. The fluid line 11 is selected so that the fluid 35 substantially covers the hot portions of the heating element 10, as well as the first coil thermostat 12, second coil thermostat 13 and high temperature cut-off 14 of the temperature control device 20. The fluid line should be sufficient to cause water to flow out of the outlet port 37 when the lid 31 is inserted and cold water is added to the tank 30.

With respect to FIG. 2, a clearer view of the wiring compartment 36 is disclosed. This compartment 36 contains, in the preferred embodiment, a pair of power terminal clips 41 and 42 mounted to the power terminal pins 52 and 53, respectively. Although clips are disclosed, it is envisioned that the power terminal pins 52 and 53 could be threaded through holes in a plastic insulating block (not shown), and mounted to clips having threaded openings for receiving a mounting screw. The wiring compartment 36 also contains neutral terminal ends 43 and 44, and optionally can include a ground jumper bar 45.

With respect to FIG. 3, the arrangement of the preferred heating element 10 and temperature control device 20 can now be explained. In the preferred embodiment, the temperature control device 20 is disposed equidistantly between the two laterally-spaced curved portions of the heating element 10. This is not a requirement, although it does assure that the control device 20 will monitor the fluid temperature more accurately.

With reference again to FIG. 1, the temperature control device 20 preferably includes a first coil thermostat 12 located near the top of the storage tank 30, below the fluid line 11. This is preferably followed by a second coil thermostat 13 located below the first coil thermostat 12, preferably about 1–2 inches below the top of the tank 30. A high temperature cut-off 14 is also located along the temperature control device 20, preferably somewhere below the first and second coil thermostats 12 and 13, although this is optional. During use of the preferred hot water heater 100, both of the resistance coils 55 and 56 can be energized to produce a high power setting, for example, about 480 watts. Depending on the size of the storage tank 30, this will usually raise the water temperature in the top 1 or 2 inches of the storage tank 30 to about 190° F. At this point, the first coil thermostat 12, which is ideally set for about 190° F., shuts off power to the first resistance coil 55. The second resistance coil 56, designed to produce about 80 watts of power, remains on to compensate for the loss of about 80 watts of energy from the water through the side walls and lid of the storage tank 30. If the water achieves a temperature of 190° F. or better at a depth where the second coil thermostat 13 is located, the second resistance coil 56 will also be disengaged from electric power, until the water cools below 190° F. once again. Because of the thermostat control, a high temperature cut-off device is not necessary, although one is provided herein as a secondary safety mechanism. Suggested resistance wire parameters are provided in Table I below for use in both hot beverage and hot water heater applications.

TABLE 1

| | Suggested Resistance Wire Parameters | | |
|---|---|---|---|
| | Size | Power/ Target | Temperature/ Target |
| first wire or coil for beverages | 32 gauge | 350–450 watts/400 watts | 150–200° F./ 188° F. |
| second wire or coil for beverages | 36 gauge | 20–140 watts/ 80 watts | 150–200° F./ 188° F. |
| first wire or coil for hot water heaters (normal service) | — | 1700–4500 watts/3800 watts | 130–160° F./ 140° F. |
| second wire or coil for hot water heaters (100 amp service) | — | 1700–4500 watts/1700 watts | 130–160° F./ 140° F. |

The temperature control device 10 also contains a high temperature cut-off, such as a switch, fuse or circuit. Numerous variations of the high temperature cut-off 14 can be employed. One popular device is a MICROTEMP thermal switch from Micro Devices rated at 240 volts, 25 amps continuous, and an open temperature of about 360° F., but other forms can be used. Additionally, a thermal protector switch available from PORTAGE would also be acceptable. A disclosure of relevant connections for the high temperature cut-off circuit is provided in U.S. Pat. No. 4,687,905, which is hereby incorporated by reference.

With respect to FIGS. 4 and 5, a preferred lid 31 for the storage tank 30 of this invention is disclosed. The lid 31 includes an inlet port 38 and an outlet port 37 for receiving and discharging water, for example, for use with a water cooler.

As shown in FIG. 4, the lid 31 can have a series of locking teeth dispersed around its circumference in order to provide a locking release for the lid 31 to facilitate service of the heating element 10 and temperature control device 20. The inlet port 38 of the lid 31 can include an inlet tube 39 for disposing ambient or chilled water into the bottom of the tank 30.

With respect to FIGS. 7–9, preferred constructions for the heating elements of this invention will now be discussed. One heating element 10 of this invention includes first and second resistance wires or coils 55 and 56 disposed on one end of the element 10 around a pair of power terminal pins 52 and 53.

The preferred resistance coils 55 and 56 are configured to provide a first wattage which is capable of heating water to at least a temperature of a hot beverage, for example, a temperature between about 150°–200° F., and a second wattage which is capable of maintaining the heated water at that elevated beverage temperature in a substantially steady-state condition. As used herein, the term "steady-state" means that the temperature of the fluid does not change more than +/–5° F. over a 60 minute period. It is known that single element immersion heaters for beverage applications reach a target water temperature of about 190°–195° F. before they turn off. The water then cools to about 175° F. prior to reenergization of the heater. These cycles occur every 20–60 minutes, or so, while the heater is on.

The preferred resistance coils 55 and 56 are provided within a protective sheath 51 and are separated from the protective sheath by an insulating medium 57. In a preferred embodiment, this medium is packed around the resistance coils and the internal portions of the power terminal pins 52 and 53, as well as the neutral pins (not shown). The insulating medium can be, for example, an insulating polymer, ceramic or other material which prevents the resistance coils from shorting out to the protective sheath 51. In the preferred embodiment, a powdered ceramic material is used, although as described below, this powdered ceramic material may be fused or pressure-bonded together to form a substantially solid material. The free ends of the protective sheath 51 are desirably plugged with an insulating composition, such as a polymer end seal 54, preferably silicone or epoxy.

As shown in FIG. 9, the free ends of the sheath 51 expose the power terminal pins 52 and 53 which can be joined to a clip 58, or other electrical connection device. In the preferred embodiment, the clip 58 is spot or TIG welded to the terminal end of the power terminal pins.

Preferred materials for the heating elements of this invention will now be discussed. The preferred corrosion-resistant sheath 51 of the heating element 10 is made of a polymer or a corrosion-resistant metal. Good examples include copper and its alloys, stainless steels, nickel and its alloys, aluminum and steel. Popular commercial alloys include Incoloy® 800, 800HT and 600 from Inco Alloys International, and 304, 316, and 308 stainless steel. The typical corrosion-resistant sheath is made to a thickness of less than about 0.1 inches, and preferably about 0.018–0.049 inches. The preferred tubular construction can be produced by drawing, extrusion or similar metalworking techniques.

The preferred resistance wires of this invention include "resistance metal" coils of round or flat stock. A popular choice is Ni-Cr wire. The coil's cross-section and length are generally related to the total wattage it generates after it is energized with electricity. One preferred coil arrangement includes side-by-side coils of 36 gauge and 32 gauge. The wattage of each element can be about 80–4500 watts, depending upon the application. For hot water heaters, about 1700 to 3800 watts is typical. For water cooler applications, a range of about 80–400 watts is useful. It is envisioned that the resistance coils 55 and 56 can be of the same gauge, length and composition or different gauges, lengths or compositions.

The preferred resistance wires of this invention are packed in an insulating medium. Such media often contain granulated ceramic materials such as MgO. In the preferred embodiment of this invention, the resistance heating coils 55 and 56 are disposed within the corrosion-resistant sheath 51, and the sheath 51 is thereafter filled with granular MgO. The resulting assembly is thereafter sealed at its ends and compressed under great force to solidify the MgO granules into a composite 51 which fixes the position of the electrical resistance coils.

The terminals 52 and 53, or cold pins, affixed to the ends of the electrical resistance wires 55 and 56 of this invention, preferably are made of a conductive metal such as copper or steel, and are approximately 1–2 inches, or preferably about 1.25 inches, in length. During use, the terminal pins 52 and 53 should generate little or no resistance heating.

From the foregoing, it can be realized that this invention provides efficient hot water heaters and improved multiple resistance wire elements. The multiple electrical resistance wire elements of this invention are energy efficient and are particularly useful for hot water heaters in portable water dispensers, such as water coolers. Although various embodiments have been illustrated, this is for the purpose of describing, and not limiting the invention. Various modifications, which will become apparent to one skilled in the art, are within the scope of this invention described in the attached claims.

What is claimed is:

1. A method of heating water dispensed from a portable water cooler dispenser, comprising:

providing a hot water heater including a polymer storage tank for containing water, a heating element for providing electric resistance heating to a portion of the water in said storage tank, said heating element having at least a first and a second resistance wire, said first and second resistance wires capable of heating said water to a temperature of less than 200° F., and said second resistance wire capable of maintaining said water at said first temperature when said first resistance wire is deactivated; and thermostatic temperature control means for consecutively disconnecting electric current to said first and second resistance wires when said water achieves a temperature of about 190°–200° F. at at least two depths in said water;

providing water into said storage tank; and electrically activating said first and second resistance wires to heat said water in said storage tank to said first temperature; and deactivating said first resistance wire while said second resistance wire maintains said water at said hot beverage temperature in substantially a steady-state condition.

2. The method of heating water of claim 1, wherein said first and second resistance wires comprise first and second helical coils insulated from one another by a solid ceramic insulation medium within a single protective sheath.

* * * * *